US006722118B2

(12) United States Patent
Meyer et al.

(10) Patent No.: US 6,722,118 B2
(45) Date of Patent: Apr. 20, 2004

(54) METHOD FOR OPEN-END ROTOR SPINNING

(75) Inventors: Jürgen Meyer, Aachen (DE); Manfred Lassmann, Nettetal (DE)

(73) Assignee: W. Schlafhorst AG & Co. (DE)

( * ) Notice: Subject to any disclaimer, the term of this patent is extended or adjusted under 35 U.S.C. 154(b) by 104 days.

(21) Appl. No.: 10/168,775

(22) PCT Filed: Dec. 22, 2000

(86) PCT No.: PCT/EP00/13203

§ 371 (c)(1),
(2), (4) Date: Jun. 21, 2002

(87) PCT Pub. No.: WO01/55490

PCT Pub. Date: Aug. 2, 2001

(65) Prior Publication Data

US 2003/0010011 A1 Jan. 16, 2003

(30) Foreign Application Priority Data

Dec. 24, 1999 (DE) ..... 199 63 087

(51) Int. Cl.[7] ..... D01H 4/08
(52) U.S. Cl. ..... 57/417; 57/404
(58) Field of Search ..... 57/404, 405, 406, 57/407, 408, 409, 410, 411, 412, 413, 414, 415, 416, 417

(56) References Cited

U.S. PATENT DOCUMENTS

| | | | | |
|---|---|---|---|---|
| 3,411,283 A | * | 11/1968 | Isomura | 57/414 |
| RE27,499 E | * | 10/1972 | Isomura | 57/414 |
| 4,497,166 A | | 2/1985 | Artzt et al. | |
| 4,593,522 A | * | 6/1986 | Ishizuka et al. | 57/400 |
| 5,916,118 A | | 6/1999 | Wassenhoven et al. | |
| 6,220,009 B1 | | 4/2001 | Coenen | |

FOREIGN PATENT DOCUMENTS

| | | |
|---|---|---|
| DE | 31 18 382 A1 | 11/1982 |
| DE | 197 09 747 A1 | 9/1998 |
| DE | 198 19 767 A1 | 11/1999 |
| GB | 1187273 | 4/1970 |
| JP | 49-54639 | 5/1974 |

OTHER PUBLICATIONS

"Break Spinning" report of the Shirley Institute, Manchester, England, 1968, pp. 76–79.
"Technische Entwicking des OE–Rotorspinnens," by Karl–Josef Brockmanns, Textil Praxis International, 1988, pp. 459–466.
"Einfluss der Faserlänge und des Faserreibungskoeffizienten auf die Formierung der, Bauchbinden," by J. Lünenscloss and W. Kampen, Melliand Textilberichte 3, 1978, pp. 181–185.
International Search Report.
German Search Report.

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

It is the object of the invention to propose a method for open-end rotor spinning, wherein the formation of cover yarn, in particular the so-called "belly bands", is at least appreciably reduced.

In accordance with the invention, the fiber flow exiting a fiber guide channel has a directional component in the direction of rotation of the rotor, while the yarn leg (3) extending, from the draw-off nozzle to the rotor groove, is curved opposite the direction of rotation of the rotor, at least near the rotor groove (1), during the spinning process. The creation of this direction of curvature of the yarn leg (3) takes place during the piecing process.

9 Claims, 9 Drawing Sheets

METHOD FOR OPEN-END ROTOR SPINNING

BACKGROUND OF THE INVENTION

The invention relates to a method for open-end rotor spinning, wherein the fibers to be spun are conveyed via a fiber guide channel into the rotor, are collected in its rotor groove of the largest interior diameter, are tied while being twisted into the yarn end in the area of a so-called tie-in zone by means of the rotor rotation and are drawn off as finished yarn through a draw-off nozzle, which is arranged centered and substantially on one level with the rotor groove.

The development of rotor spinning goes back a very long time, wherein the industrial use of this method only started on a larger scale in the sixties. A multitude of inventions was created not only in peripheral areas, i.e. from the sliver feed, the opening up into individual fibers and feeding of the individual fibers to the spinning rotor, as well as the drawing-off and winding-up of the yarn, but also in the core area of yarn formation, i.e. inside the rotor, only a small portion of which has entered into the present-day, very efficient automatic rotor spinning machines, which produce a yarn of high quality.

All methods have essentially in common that fibers from a sliver, which have been opened into individual fibers by means of an opening cylinder, are conducted together by means of a vacuum air flow to the rotor and are conveyed against a circumferential wall by means of the air flow and/or centrifugal force. As a rule, the shape of the inner rotor wall permits the collection of these fibers by forming an almost closed fiber ring. These collected fibers are continuously tied-up into a yarn end, wherein the yarn performs a true twist with every revolution of the rotor. The yarn rotation wanders opposite the yarn draw-off direction from the draw-off nozzle in the direction toward the yarn collection and, by the twisting of the doubled yarn, makes its continuous spinning on the open yarn end possible. The area where this piecing of the fibers to the yarn end takes place, is located between the detachment point of the yarn being created from the rotor wall, and the transition from the twisted yarn into the untwisted small sliver. It is called the tie-in zone.

Normally a yarn end for a piecing, which is fed into the rotor by the draw-off nozzle, is taken along in the direction of the rotor rotation by the air flow formed by the rotor rotation, at the latest when reaching the rotor groove. This curvature of the yarn end in the direction of rotor rotation is then maintained during the entire spinning process.

As can be seen from JP-OS 49-54 639, a malfunction can be caused by intensive soiling in the rotor, large bundlings of fibers, or the loss of the vacuum supply. The flipping of the curvature of the yarn end caused by this is quite undesirable, as stated in this Japanese laid-open document, since the yarn created in the course of this is said to show considerable disadvantages in respect to strength and evenness in comparison with a yarn, whose yarn end is curved in the direction of the rotor rotation. To prevent this flipping of the curvature opposite the rotor rotation direction, it is proposed in JP-OS 49-54 639 to arrange appropriate yarn contact elements on the draw-off nozzle and the rotor bottom, which are intended to stabilize the desired direction of curvature.

Within the scope of the further developments of the open-end spinning methods it was possible to definitely improve the processes, so that it is normally possible to avoid large collections of fibers, soiling or the failure of a vacuum. Accordingly, modern open-end spinning machine in principle are operated without additional aids for maintaining the curvature of the yarn end in the direction of rotation of the rotor.

A rotor spinning arrangement is described in "Breakspinning", report of the Shirley Institute, Manchester, England, 1968, pages 76 to 79, wherein a funnel-shaped false twist element is arranged inside of the actual spinning rotor, which itself has the shape of a pan. This false twist element extends directly up to the fiber collection surface of the rotor. The rotor and the false twist element are separately seated and can also be separately driven. This means that the false twist element can be arranged in a stationary manner, as well as being driven in the direction of the rotor rotation, or opposite the direction of rotor rotation. Openings are arranged in the area of the collecting surface, by means of which a suction flow is created because of the centrifugal force of the rotor rotation. The fibers are fed in the radial direction on the collecting surface, which has the approximate shape of a cylinder surface. The yarn is drawn off through the rotor shaft, i.e. at the location opposite the fiber feed-in.

As described there, the relative direction of rotation of the yarn leg can be changed in relation to the rotor rotation as a function of the direction of rotation of the false twist arrangement. It is stated in conclusion that this relative rotation direction of the yarn leg clearly affects the yarn quality. Thus, in the positive direction, i.e. with the yarn leg running faster than the rotor, the yarn quality is said to be better by approximately 18% than with the oppositely directed relative speed of the yarn leg in relation to the rotor rotation.

A problem, which reduces the employment options of the rotor yarn produced on modern open-end rotor spinning machines, which otherwise has very even and good physical textile properties, resides in the formation of cover yarn, the so-called "belly bands", which are wound in alternating directions of rotation either loosely, but partially very tightly, around the yarn periphery. The yarn structure, or the fiber orientation and fiber stretching, suffers because of this, with the result that the range of application of open-end rotor yarns becomes limited.

SUMMARY OF THE INVENTION

It is therefore the object of the invention to propose a method which limits the creation of cover yarn at least noticeably.

In accordance with the invention, this object is attained by providing a method for open-end rotor spinning, wherein the fibers to be spun are conveyed via a fiber guide channel into the rotor, are collected in its rotor groove of the largest interior diameter, are tied while being twisted into the yarn end in the area of a so-called tie-in zone by means of the rotor rotation and are drawn off as finished yarn through a draw-off nozzle which is arranged centered and substantially on one level with the rotor groove. The fiber flow exiting from a fiber guide channel has a directional component in the direction of rotation of the rotor, and the yarn leg extending from the draw-off nozzle to the rotor groove is curved, at least in the vicinity of the rotor groove, opposite the direction of rotation of the rotor during the spinning process.

The invention is advantageously further developed in a preferred embodiment of the method wherein the fiber flow is essentially fed to a fiber slide surface located between the rotor opening and the rotor groove. The direction of curvature of the yarn leg is created during the piecing process. In a first phase of the piecing process, a rotary flow directed tangentially opposite the direction of rotation of the rotor during its operation is caused to act on the yarn end introduced into the rotor for piecing, which flow is sufficient for creating the intended direction of curvature of the yarn leg. In such first phase of the piecing process, the rotor is initially driven opposite the direction of rotation of the rotor during its operation in such a way that the intended direction of curvature of the yarn leg occurs, and that the direction of rotation of the rotor during its operation does not exceed an angular acceleration which could lead to the flipping of the direction of curvature.

The method in accordance with the invention is based on the knowledge that, with a curvature direction of the yarn end in the direction of rotation of the rotor, fibers which, coming from the fiber slide face, directly reach the tie-in zone of the yarn end are initially tied to the twisting yarn in a direction which is opposite the normal yarn twisting direction, wherein in the course of the continued draw-off of the yarn, along with a simultaneous twisting thereof around its own axis, the direction of twisting of this fiber changes to the main yarn twisting direction. In those cases in particular in which the fiber reaches the tie-in zone first with its end located at the front in the direction of rotation of the rotor, several locally concentrated wraps can be created when the direction of rotation is changed. The yarn is constricted at this point with the result, that the yarn is uneven and the twist propagation is braked, which results in a loss of strength of the yarn in turn.

The setting in accordance with the invention of the curvature of the yarn opposite the direction of rotation of the rotor results in single fibers, which reach the yarn end in the tie-in zone, are immediately tied on, or in, in the normal twisting direction of the yarn and therefore do not cause any interference with the yarn production, nor a lack of quality arising therefrom.

Because of the detachment of the yarn end from the rotor groove, the angular speed of the detachment point, or of the tie-in zone, differs from the angular speed of the rotor. In the case of a curvature of the yarn end in the direction of rotation of the rotor, the angular speed of the tie-in zone is greater than that of the rotor, the tie-in zone runs ahead of the rotor. In the case of the present invention, with a curvature of the yarn end opposite the direction of rotation of the rotor, the tie-in zone trails behind the rotor. Because of this trailing of the tie-in zone, the fibers are drawn out of the rotor groove under an increased tensile stress. This results in additional stretching, which leads to an improved orientation of the fibers and makes possible an increased use of the strength of the fiber substance. In contrast to yarn which was produced with a leading tie-in zone, yarn produced in this way has a distinctive yarn core of stretched fibers.

The fact that with a trailing tie-in zone the fibers are tied to the yarn end with the same orientation with which they were conducted through the fiber guide channel to the rotor, also has an advantageous effect on the yarn structure. Here, the tangential alignment of the fiber flow in the direction of rotation of the rotor also assures the stretching of the fibers, because the inner surface of the rotor, i.e. the fiber slide surface, has a greater speed than the fiber flow impinging on it. This continuous maintenance of the stretching direction additionally furthers the stretched deposition of the fibers in the yarn structure.

By feeding the fiber flow onto a fiber slide surface, the fiber flow exiting the fiber guide channel is prevented from directly hitting the tie-in zone or the yarn end.

In accordance with the invention it is necessary to establish the trailing of the tie-in zone already in the course of the piecing procedure, in particular for obtaining an even yarn quality during the entire spinning process.

If no appropriate precautions are taken during the piecing procedure, leading of the tie-in zone automatically occurs because of the air flow which rotates along with the rotor. This orientation of the yarn leg is additionally aided by the rotation flow being created because of the tangential junction of the fiber guide channel and of the vacuum prevailing in the rotor housing. In the course of introducing the yarn end it is accordingly necessary to see to it that an opposite curvature is being formed.

This can be accomplished for one by generating a rotary flow opposite the direction of rotation of the rotor while the rotor still stands still, or does not yet rotate very fast, which acts on the yarn end being conducted from the draw-off nozzle to the rotor groove and which impresses the desired curvature on the yarn end. During this time the suction of the rotor housing can be maintained, since it aids the active air supply in the direction opposite to the rotation, which is in contrast to the passive suction of the fiber guide channel.

After the yarn end with the direction of curvature opposite the direction of rotation of the rotor has reached the rotor groove, this state is stabilized with the increasing number of rotor revolutions and therefore also the centrifugal force, and then remains as stable as in the state with a leading tie-in zone. In this connection the fact should be taken into consideration that the interferences mentioned in the prior art, which could cause a curvature change, are no longer relevant because of the command of the spinning process, as well as because of keeping the rotor clean.

The means used for generating the rotary flow can also be used for the so-called rotor flushing if it is necessary to remove the fibers which have reached the rotor in the course of a so-called fiber tuft equalization prior to the actual piecing (for example, see DE 197 09 747 A1).

Alternatively there is also the possibility of turning the rotor opposite its normal direction of rotation prior to the piecing procedure in order to cause in this way a deposition of the yarn end in this direction of rotation, which is opposite to the direction of rotation during its operation. In this case the suction of the rotor housing should be switched off in order not to endanger the desired deposition of the yarn leg by the suction flow, which causes a rotary flow in the direction of rotation of the rotor because of the tangential orientation of the fiber guide channel.

Following this, the rotor should be switched into the operating direction of rotation, but this process must not take place so abruptly that the direction of curvature of the yarn end flips again. Here, too, a stable curvature of the yarn end opposite the direction of rotation of the rotor is assured after the rotor has been run up. In addition, a slight twisting open of the yarn end during the rotation of the rotor opposite the normal operating direction also is advantageous for the piecing process. This yarn end, which has been opened further, is then better suited for a piecing process.

Besides the variations for creating the direction of curvature of the yarn end opposite the direction of rotation of the rotor described up to now, there are alternatively options of forming a fiber ring prior to introducing the yarn end into the rotor, or to switch the fiber flow into full strength after the yarn end has reach the rotor groove and the rotor has the number of rotor revolutions necessary for the process.

A further possibility for achieving the curvature in accordance with the invention of the yarn leg, or of the trailing thereof, consists in generating a yarn loop during the piecing procedure. In the course of this the yarn end is conveyed in the customary manner through the yarn draw-off tube into the rotor. Thereafter, a suction flow is generated in a radially spaced apart suction channel, while the spinning vacuum is shut off. Because of this the yarn end wanders from the draw-off nozzle into this suction channel. The feed length is regulated by the controlled feeding of the yarn through the yarn draw-off tube. At the end of feeding, the yarn end is clamped in the suction channel. Thereafter, a spinning vacuum is again generated and the rotor is started. Because of a continued return feed of the yarn, a larger size loop is formed between the draw-off tube and the suction channel. The air rotation caused by the rotor rotation pulls the loop in the direction of rotation of the rotor. After the loop has been sufficiently aligned in this way, the clamping is released, so that the yarn end can be deposited in the rotor groove opposite the direction of rotation of the rotor. Thereafter yarn draw-off is very rapidly accelerated, and the previously stepped yarn feed is restarted. In the process the yarn end is tied to the fibers. As in the already mentioned cases, the curvature of the yarn leg is stabilized by means of the centrifugal force then applied. With this process variation it is only necessary to see to it that no early feeding of fibers into the spinning rotor takes place in order to prevent the flipping of the yarn leg into the other direction of rotation in a phase which has not yet been stabilized by centrifugal force.

Stopping the yarn feed prior to the piecing process is not tied to a particular method here. For example, the fed-in fiber tuft can be deflected as long as is required by means of suction air directly downstream of the feed table. On the other hand, it is also possible to displace this point of the fiber flow deflection into the area of the fiber feed channel (for example, see DE 31 18 382 A1). It is only important that the fiber feed is completely stopped in the piecing phase in which the curvature of the yarn is formed.

BRIEF DESCRIPTION OF THE DRAWINGS

The invention will be explained in greater detail in what follows by means of exemplary embodiments. The associated drawings show in FIGS. 1*a* and 1*b*, various variations of the generation of cover yarn in the course of spinning with a leading tie-in zone, FIGS. 2*a* and 2*b*, various variations of the generation of cover yarn in the course of spinning with a trailing tie-in zone, FIG. 3, a channel plate adapter with air outlet openings arranged around the draw-off nozzle for creating a rotating air flow, FIG. 4, a lateral view of FIG. 3, showing the rotor in addition, FIGS. 5*a* to 5*c*, various movement phases of the rotor during the piecing process for creating a trailing tie-in zone, FIG. 6, the chronological sequence of the winding speed of the rotor in the phases in accordance with FIGS. 5*a* to 5*c*, FIG. 7, a front view of the essential spinning elements of a rotor spinning arrangement, FIG. 8, a lateral view of the working element of a spinning box, FIG. 9, a sequence of the yarn return for creating a trailing tie-in zone, FIG. 10, a lateral view of the working elements of a spinning box, partially modified for the execution of the sequence represented in FIG. 9, FIG. 11, a lateral view essentially showing the spinning chamber, as well as a piecing cart arranged in front of the spinning box, respectively in partial views, and FIG. 12, a front view of the essential spinning elements of a rotor spinning arrangement, with a suction device for the temporary deflection of the sliver.

DESCRIPTION OF THE PREFERRED EMBODIMENT

Figure 1A:
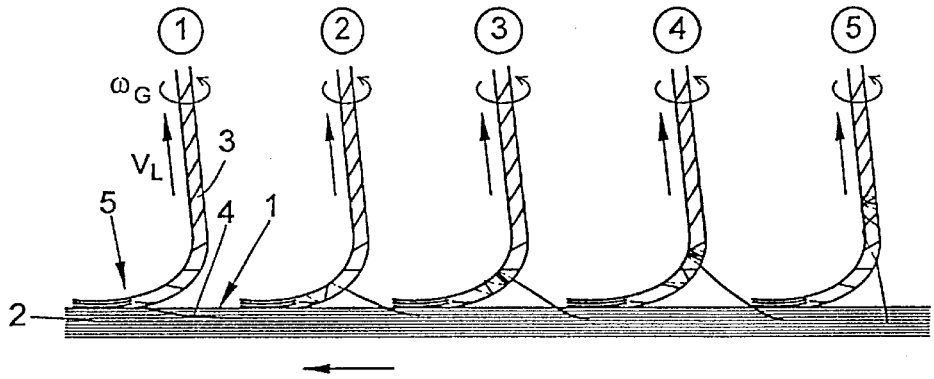

The phases of the tie-in of a single fiber 4 during spinning with a leading tie-zone, i.e. alignment of the yarn leg 3 in the direction of rotation of the rotor, are represented in FIG. 1*a*, wherein this single fiber 4 reaches the rotor groove 1 from the fiber slide surface 2 at a time when its front end is grasped in the tie-in zone 5 of the yarn leg 3 (phase 1). It can be easily seen that the fiber twist direction in the yarn leg 3 is Z-twist. In contrast to this, the fiber 4, whose tip has been grasped, is initially wound in S-turns around the yarn surface, as can be seen in phase 2. In the course of the further yarn draw-off VL, the tip of the fiber 4 nears the point at which further portions of the fiber 4 are wound around the yarn surface at that instant. A change in the direction of twist from S to Z takes place in phase 4, in the course of which several concentrated wraps can be created. These wraps as a whole tie the yarn together and form so-called belly bands, which can be in the way in the later processing stage and as a whole reduce the quality of the yarn. In phase 5 it can also be seen that the remainder of the fiber 4 is wound up in a Z-twist, i.e. the same twisting as the remaining yarn.

Figure 1B:
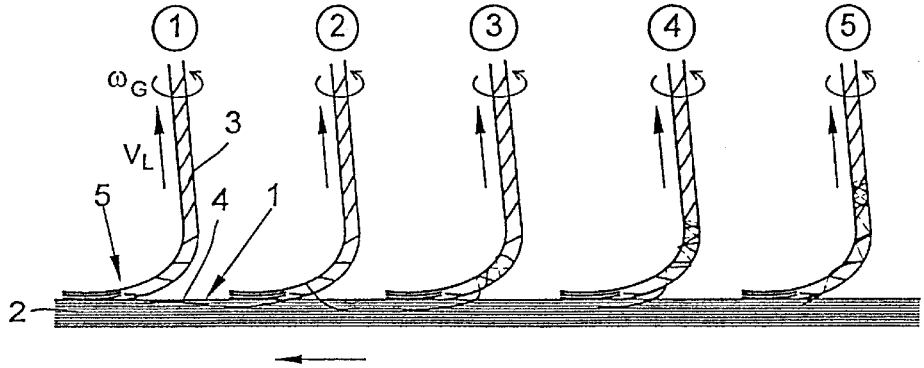

If the end of the fiber 4 is initially spun onto the tie-in zone 5 (FIG. 1*b*). the following sequence results: in phase 1, the fiber meets the tie-in zone and is grasped in phase 2 by the yarn leg 3 in the area of the tie-in zone 5. The fiber tip of the fiber 4 follows the direction of rotation $\omega_G$ of the yarn around its own axis and is drawn off in a Z-twist until it is completely drawn out of the rotor groove 1 and is wound around the yarn core (phases 3 to 5), while the fiber end is wound in an S-twist around the fiber core. The fiber is not solidly bound into the yarn core, but rests loosely around the yarn surface.

Figure 2A:
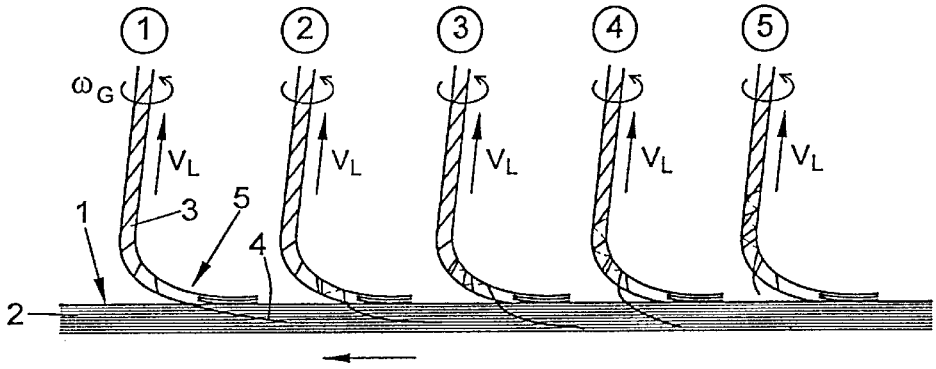
Figure 2B:
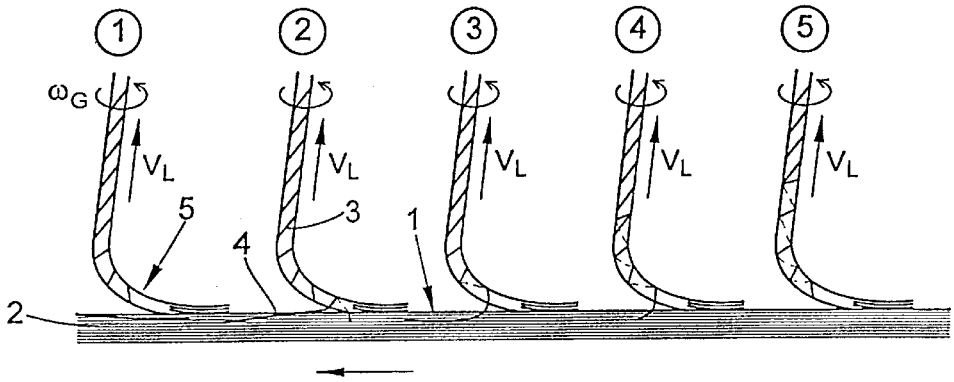

But in FIGS. 2*a* and 2*b* it is shown how the tie-in of an individual fiber 4 to the yarn leg 3 takes place within the tie-in zone 5 if spinning is performed with a trailing tie-in zone 5, i.e. with a curvature of the yarn leg opposite the direction of rotation of the rotor.

FIG. 2*a* shows in phases 1 to 5 how a fiber 4, coming from the fiber slide surface 2, reaches the tie-in zone 5 with its tip and is wound around the yarn surface. It can be seen here that from the start the fiber 4 is tied to the yarn leg 3 in the same twisting direction as all other fibers. Only the pitch of the twist differs slightly from the other fibers. The same occurs in accordance with FIG. 2*b* if the fiber initially meets the tie-in zone 5 with its end.

Therefore the yarns produced in this manner do no longer contain fibers with a twisting direction different from the normal yarn twisting direction. Above all, wraps are no longer created because of a change in the twisting direction, which would affect the yarn quality, and therefore the possibilities of use of the spun yarn.

Since in the course of a normal piecing process a curvature in the direction of the rotation of the rotor inevitably results because of the air flow rotating along with the rotor, it is necessary to take measures for creating the opposite direction of curvature of the yarn leg.

Figure 3:
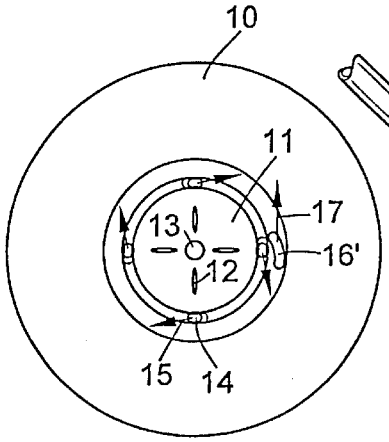
Figure 4:
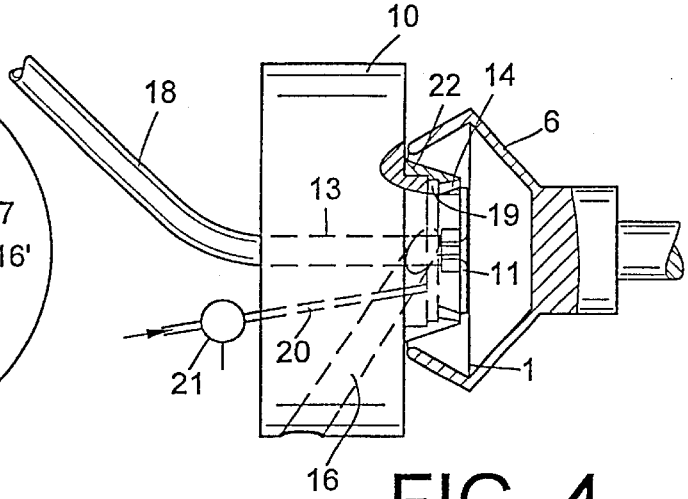

A first variation for the creating in accordance with the invention of a trailing tie-in zone is represented in FIGS. 3 and 4 and will be described in greater detail in what follows.

A channel plate adapter 10, which can be inserted into a channel plate, supports a draw-off nozzle 11 with a nozzle opening 13, as well as radial notches 12, known per se, which are used for increasing the spinning dependability. Air outlets 14 which, as indicated by the arrows 15, have a tangential direction component, terminate radially outside the draw-off nozzle 11. Furthermore, a fiber guide channel terminates axially and radially offset, of which the mouth opening 16' can be seen. The arrow 17 indicates that this fiber guide channel, too, has a tangential orientation, which can be seen more clearly in FIG. 7. The tangential direction components 15 and 17 are oppositely directed.

The air outlets 14 are supplied via an annular channel 19, which itself is connected to a compressed air source, not represented, via a compressed air supply device 20 and a valve 21.

The compressed air supply device 20 can also be connected to a so-called piecing aid which, by means of an air feed, causes a rotor flushing of the rotor prior to the actual piecing process after fibers had been pre-fed for fiber tuft equalization which are not to be made available for the piecing process. A device as described in DE 197 09 747 A1, for example, would be suitable for this. Therefore it is not necessary to address further details here.

As can be seen in FIG. 4, the annular channel 19 is created by an appropriate shaping of the base body of the channel plate adapter 10, together with a cap 22 which has the air outlets 14. The nozzle opening 13 terminates in a yarn draw-off tube 18, through which the yarn end is introduced for piecing and, after piecing, is continuously drawn off during the spinning process.

The tangential direction of the fiber flow indicated by 17, which is caused by the orientation of the fiber guide channel 16, corresponds to the direction of rotation of the rotor during its operation. In contrast to this, the air rotation direction (see arrows 15), which can be achieved by feeding compressed air through the air outlets 14, is directed opposite the direction of rotation of the rotor. The air supply is limited to a first piecing phase by means of the valve 21, during which the yarn end is introduced into the rotor through the yarn draw-off tube 18 and the nozzle opening 13. When the yarn end reaches the rotor groove 1, this rotating air flow must assure that the yarn end is curved opposite the direction of rotation of the rotor. After rotor revolutions which apply sufficient centrifugal forces to the yarn end have been reached, flipping of the direction of deposit of the yarn end is no longer to be expected. The further spinning process can be solidly performed with a trailing tie-in zone.

A further variation for obtaining an appropriate curvature of the yarn leg 3 is represented in FIGS. 5*a* to 5*c* and 6.

Figures 5A, 5B, 5C:
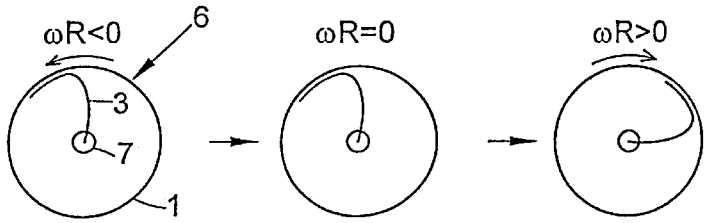

FIG. 5*a* shows a rotor 6, whose direction of rotation, or angular speed $\omega_R<0$, i.e. has been set opposite the direction of rotation of the rotor during its operation. The yarn leg 3, introduced into the rotor 6 through the draw-off nozzle 7, is accordingly deflected into this direction of rotation of the rotor when it reaches the rotor groove. In this case the vacuum supply to the rotor housing should be turned off, in order not to create an opposite rotational flow because of the tangential termination of the fiber guide channel.

FIG. 5*b* shows the stopped rotor ($\omega_R=0$) while the yarn leg 3 remains in the position it has reached in accordance with FIG. 5*a*. FIG. 5*c* then shows the run-up of the rotor in the direction of rotation during its operation ($\omega_R<0$). In the course of this the direction of curvature of the yarn leg 3 is maintained. The acceleration must be limited in such a way that flipping of the direction of curvature of the yarn leg 3 into the direction of rotation of the rotor is prevented.

Figure 6:
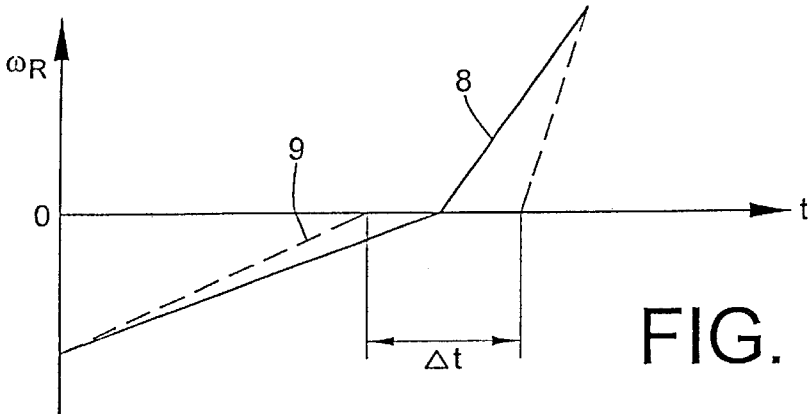

FIG. 6 shows the sequence of movements of the rotor in the first phase of the piecing process, in which the curve 8 shows a variation in which the direction of rotation of the rotor is switched directly from reverse running to forward running. But the curve 9 shown in dashed lines shows a dwell time )t of the stopped rotor. These sequences of movement are primarily a function of the drive mechanisms used. Different variations of such drive mechanisms will be discussed in greater detail below.

Figure 7:
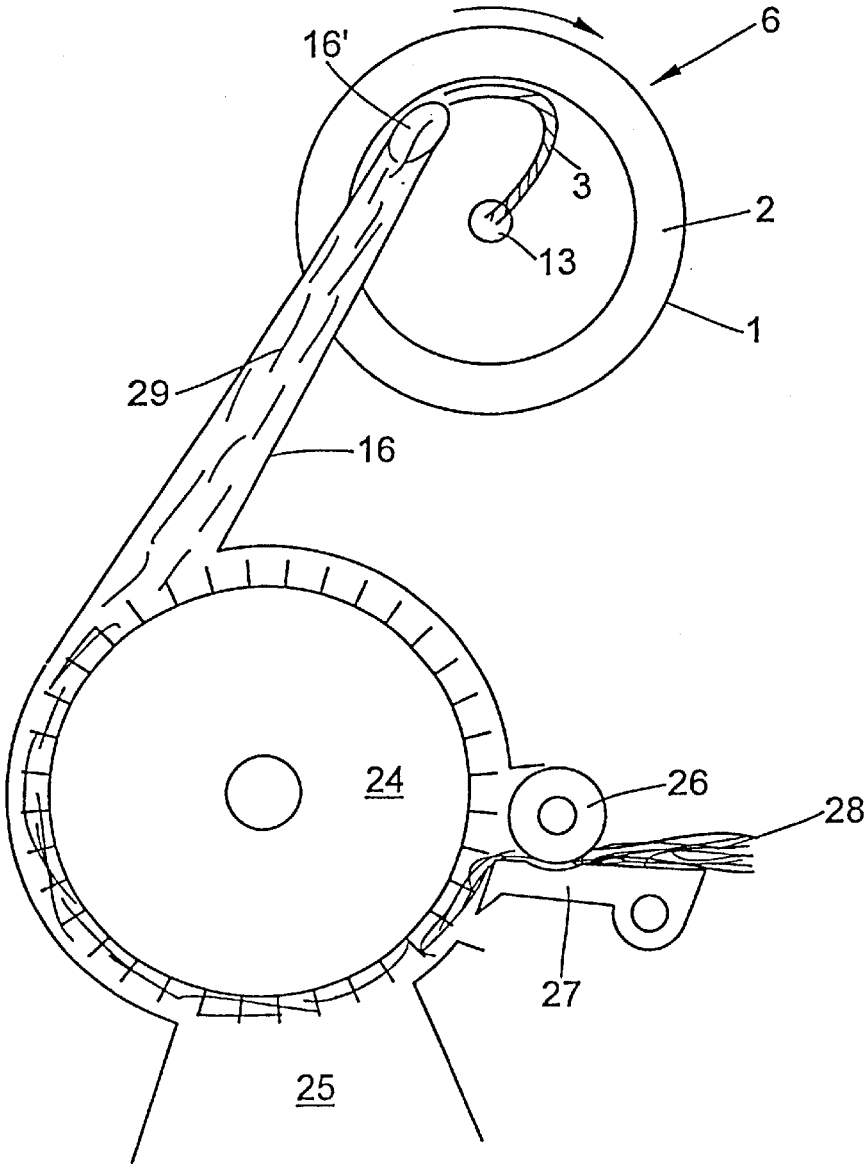

In FIG. 7 it is shown how a sliver 28, which is guided between a clamping spot between a feed roller 26 and a clamping table 27, comes into the area of the teeth of an opening cylinder 24, which rotates in the interior of an opening cylinder housing 23. When the sliver leaves the clamping spot between the feed roller 26 and the clamping table 27, it is opened into individual fibers by means of the opening cylinder 24, and dirt particles are removed through a dirt removal opening, 25. The fibers, which have been combed out by means of the opening cylinder 24, then reach a fiber guide channel 16, through which they are aspirated by means of the vacuum prevailing in the rotor housing and are further accelerated. By means of the increasing taper of the fiber guide channel 16, the fiber flow 29 is accelerated and the fibers are further stretched in the process. The fiber guide channel 16 opens at a fiber guide channel opening 16' into the rotor in such a way that the fibers meet the fiber slide surface 2 of the rotor 6 tangentially and are further accelerated by the rapidly rotating rotor 6 and are stretched.

Because of the trailing tie-in zone, the direction of orientation of the fibers is not again changed even in the course of the yarn formation, because the yarn end is oriented toward the mouth 16' of the fiber guide channel 16, as can be seen in FIG. 7, and therefore the fiber tips are first tied to the yarn end. In contrast to this, with a leading tie-in zone the fiber ends are first tied to the yarn end.

Figure 8:
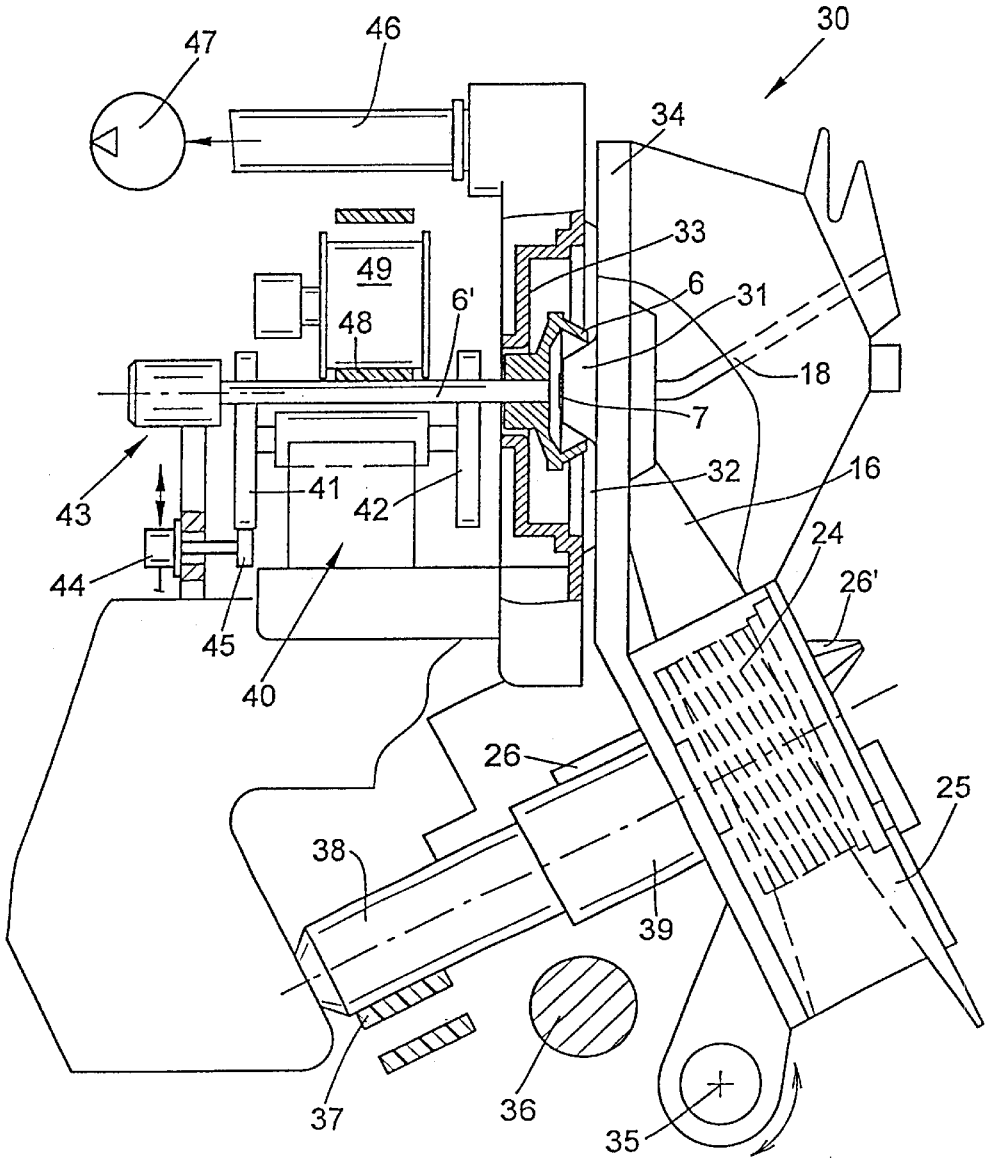

FIG. 8 shows the components 30 of a spinning box which are part of the spinning process. The rotor shaft 6' of the rotor 6 is radially seated in a support ring bearing 40, i.e. between the nips of support rings 41, 42 arranged in pairs. An axial bearing 43 of the rotor is arranged at the end of the rotor shaft 6', which radially fixes the rotor in place in both directions. This can be a magnetic radial rotor bearing here, such as described and represented in DE 198 19 767 A1, for example.

The rotor 6 is arranged in a rotor housing 33, which is connected via a suction line 46 with a vacuum source 47, so that a permanent spinning vacuum prevails in the rotor housing 33. This spinning vacuum primarily provides that the fibers are aspirated through the fiber guide channel 16 into the rotor 6.

A channel plate 32 is arranged in a pivotable cover element 34 and supports a channel plate adapter 31. The cover element 34 can be pivoted around the pivot shaft 35, by means of which the rotor housing 33 is opened. In this state the rotor 6 can be cleaned or removed, for example. Accordingly, this cover element 34 is opened prior to the piecing process by a service unit, which customarily can be displaced along the rotor spinning machine in order to perform the cleaning of the rotor.

The opening cylinder 25 is also seated by means of a bearing bracket 39 in the pivotable cover element 34 and is driven via a wharve 38 by means of a tangential belt 37. A driveshaft 36 drives the feed roller 26 by means of a worm drive, not represented here. On its front end, the feed roller has a crown 26', on which a drive mechanism of the piecing cart can be placed in order to be able to perform the driving of the feed roller 26, controlled by the piecing cart, during the piecing process.

The rotor 6 is driven via its rotor shaft 6' by means of a tangential belt 48, which during its operation is maintained in frictional contact with the rotor shaft 6' by means of a pressure roller 49. Customarily this tangential belt extends over the entire length of the rotor spinning machine, so that it drives all rotors on a side of the machine.

A drive motor 44 is additionally provided which, by means of a friction wheel 45, acts on one of the support rings 41 as soon as it has been brought into contact with it. For this purpose this drive mechanism is arranged to be moved toward or away from the support ring 41, as indicated by the two-headed arrow, by means of a lifting device, not represented. This additional drive mechanism 44,45 is employed during the first phase of the piecing process in order to create an oppositely-extending direction of rotation of the rotor when the contact roller 49 is lifted off, and with it also the tangential belt 48, such as explained in the course of the description of FIGS. 5*a* to 5*c*. Since this drive mechanism does not have to provide high numbers of revolutions, it can be of very small size.

It would also be alternatively conceivable to arrange the drive mechanism on the service unit and to introduce it into the spinning box through the rotatable cover element 34.

The reversal of the direction of rotation of the rotor could also be accomplished in that a second tangential belt is extended over the entire length of the machine, whose direction of movement is opposite that of the tangential belt 48. Then this second tangential belt would be temporarily pressed against the rotor shaft 6' by means of a second contact roller during the first phase of the piecing process.

Alternatively to the generation of the opposite direction of rotation it would also be conceivable to employ individual drive mechanisms for rotors, whose direction of rotation can be easily reversed. Such an individual drive mechanism is described by way of example in DE 198 19 767 A1. It is therefore not necessary to provide a detailed description of such a drive mechanism at this point.

Figure 9:
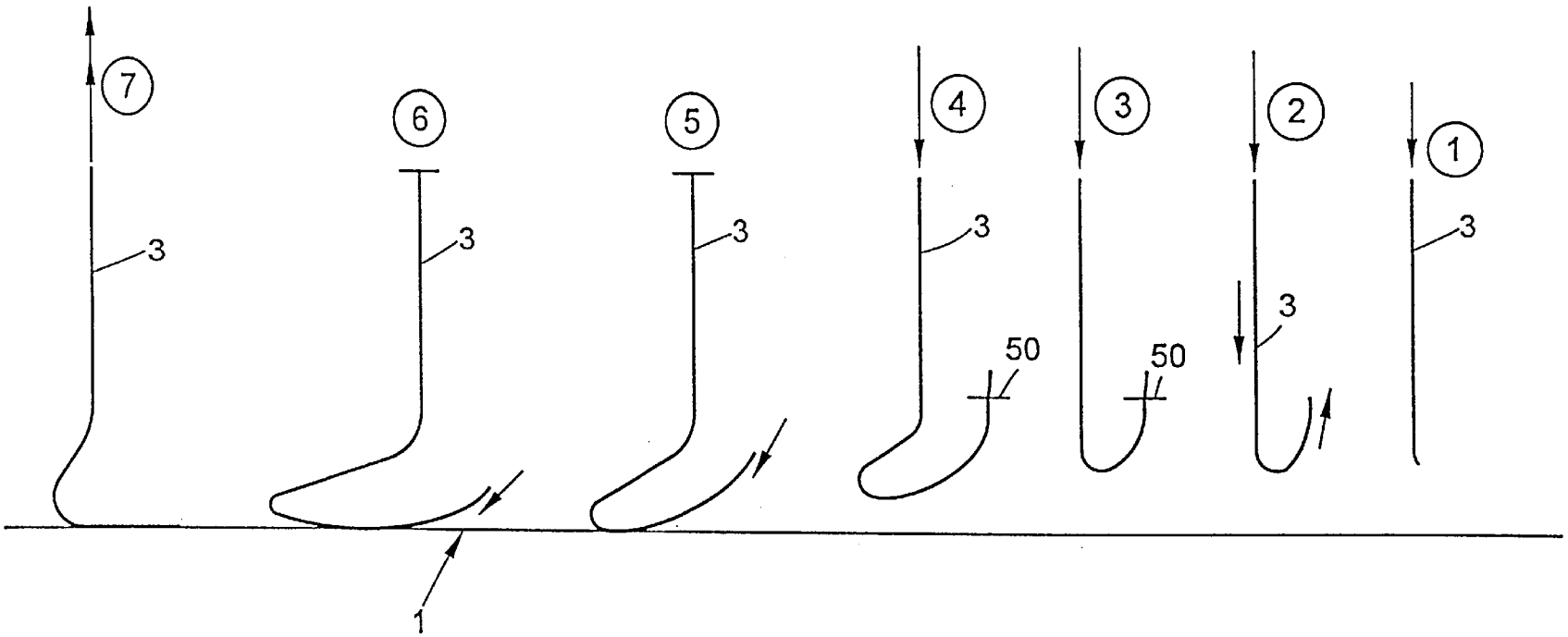

A further method for forming the curvature of the yarn 3 opposite to direction of rotation of the rotor is represented in six phases in FIG. 9. The first phase shows the customary feeding of the yarn through the yarn draw-off tube into the spinning chamber, or the rotor, by means of the effects of the vacuum (spinning vacuum) prevailing in the spinning chamber.

Figure 10:
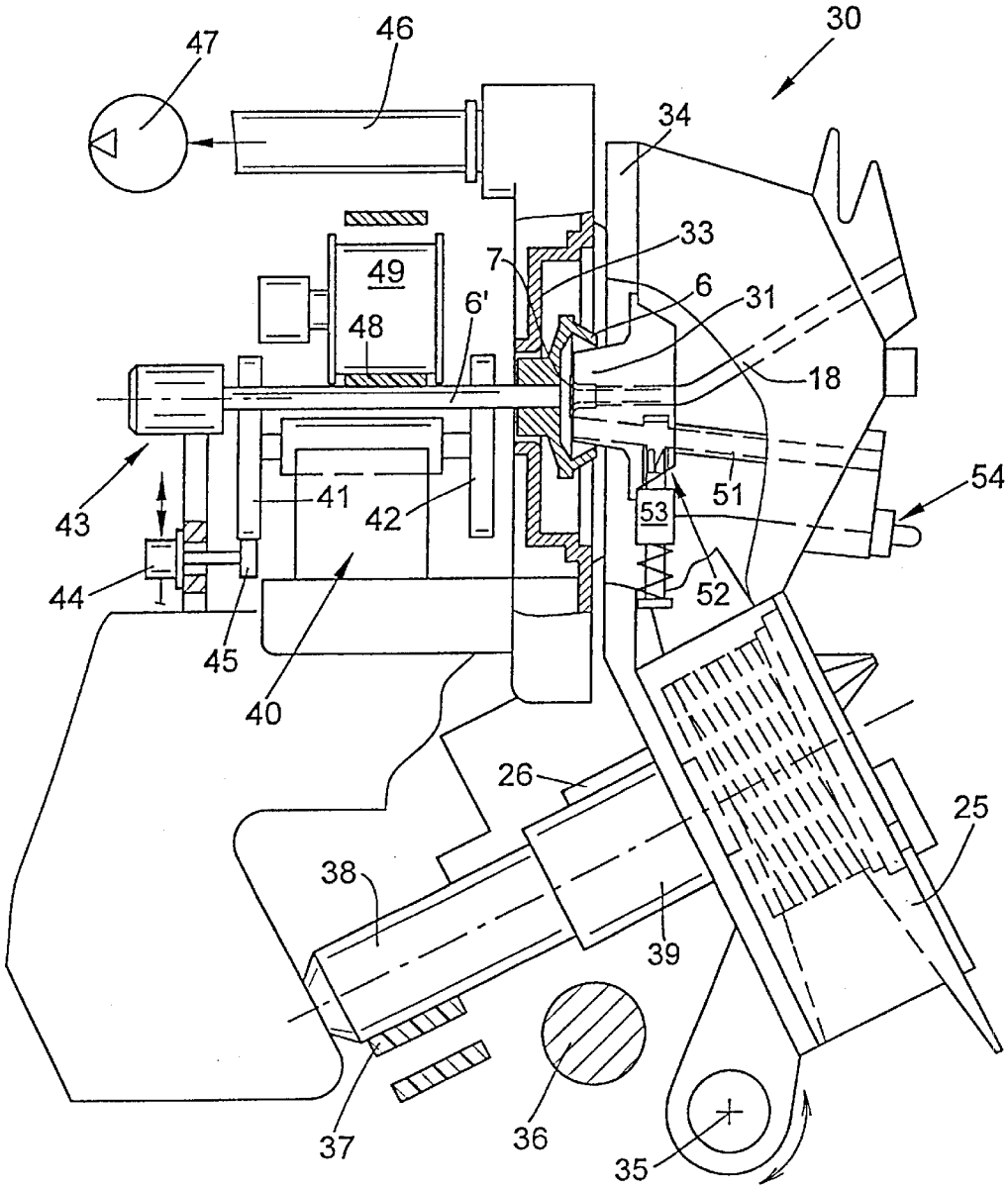
Figure 11:
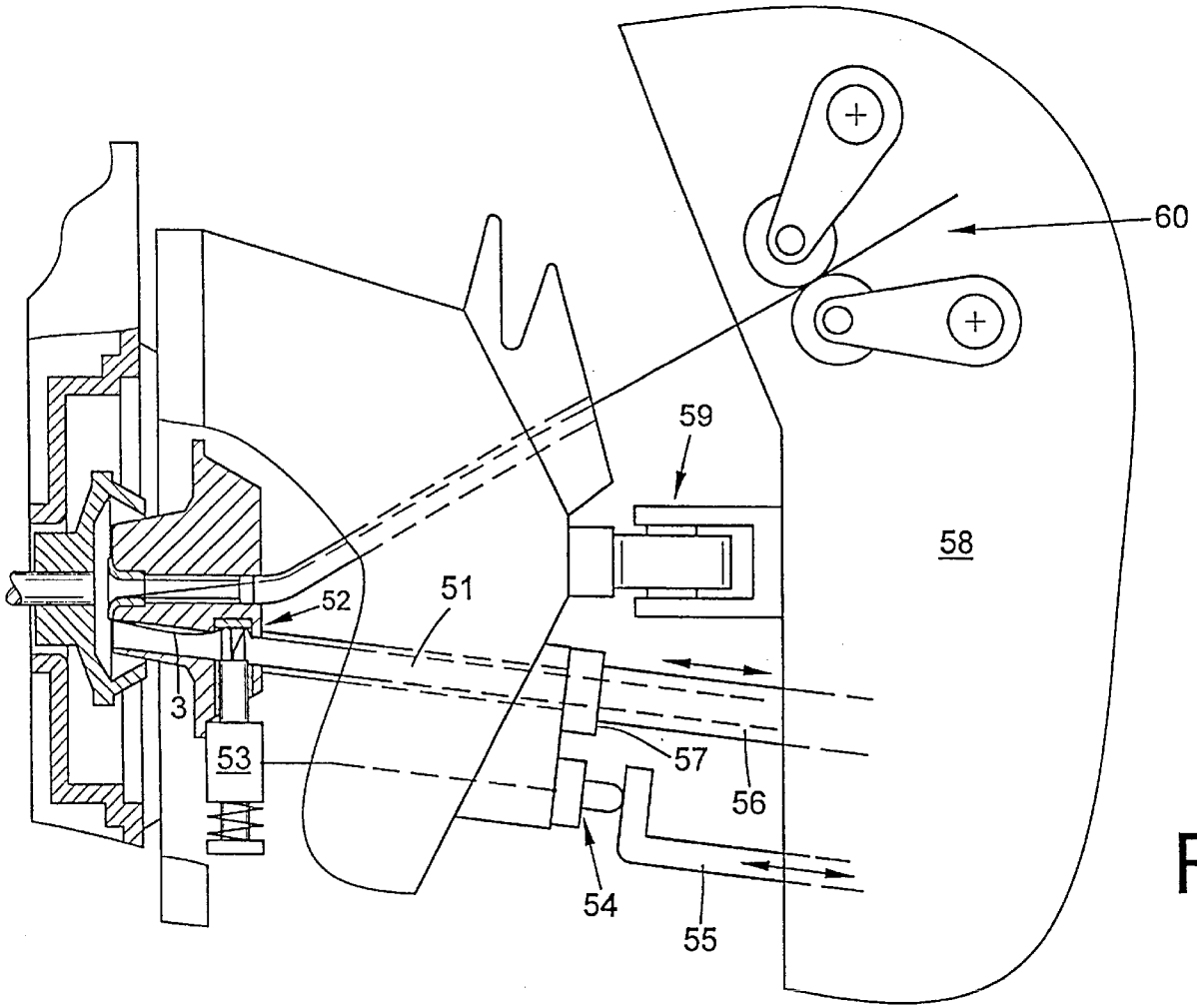

In a second phase the yarn 3 is deflected around the draw-off nozzle 7 into a suction channel 51 (see FIGS. 10 and 11). This takes place in that the spinning vacuum is switched off and an auxiliary air flow is generated in the suction channel 51. After the end of the yarn 3 has been aspirated sufficiently far into the suction channel 51, it is clamped by means of a clamping device 50 (only schematically indicated in FIG. 9) in the suction channel 51 (phase 3).

In phase 4, additional yarn is fed in through the yarn draw-off tube while the spinning vacuum is again applied and the rotor is started in its customary running direction. By means of this a loop is formed in the yarn 3, which extends in the direction of the rotor rotation.

In phase 5 the clamping by the clamping device 50 is released after sufficient yarn has been introduced into the rotor 6, so that the deposition of the yarn end 3 opposite the direction of rotation of the rotor is assured.

Phase 6 shows that the yarn end coming out of the suction channel 51 is deposited in the rotor groove 1.

It is shown in phase 7 that in the course of the continued run-up of the rotor the yarn is drawn-off the rotor as rapidly as possible, in particular to avoid a larger overlap between the yarn and the further fed-in fibers. While no fibers must be supplied to the rotor in phases 1 to 6 in order to avoid the flipping of the yarn end in the direction of rotation of the rotor, the full fiber flow must be available suddenly in phase 7 in order to have a sufficient amount of fibers available in the rotor collecting groove 1, which can be tied to the yarn end. It is assured in this way that the cross section and the solidity of the so-called piecer approach that of the normal yarn as closely as possible.

FIG. 10 shows a suction/clamping device 53 in the suction channel 51. If it is possible to set the fed-in length of the yarn by means of a yarn feeding device 60 (FIG. 11) exactly in such a way that an exactly predetermined length of the yarn is aspirated in the suction channel, it is merely necessary to provide a clamping device. A more detailed representation of such a clamping device has been omitted here, since only the blade is omitted there.

But if the yarn is to be cut to size in the suction channel 51, it is necessary to provide a suction/clamping device 53. An actuating switch 54 is coupled with the suction/clamping device 53 and can switch the latter on and off. As shown in FIG. 11 in connection with this, an actuating rod 55 is arranged on the piecing cart 58, which can act on the actuating switch 54 in a controlled manner. The piecing cart 58 moreover contains a suction tube 56, which can be connected by means of a sealing element 57 to the suction channel 51. By means of this the auxiliary air flow can be generated, chronologically controlled, in the suction channel 51 for forming the yarn loop in the end.

A support of the piecing cart 58 can also be seen and has a roller which supports it along the spinning machine against the respective boxes in the course of the displacement of the piecing cart 58.

The switching processes, as well as the supply of the auxiliary air flow, can also be performed by the spinning station itself. The same vacuum source which provides the spinning vacuum can be used for this. In this case in particular the cutting to size of the yarn 3 by means of the clamping/cutting device 52 is advantageous.

Figure 12:
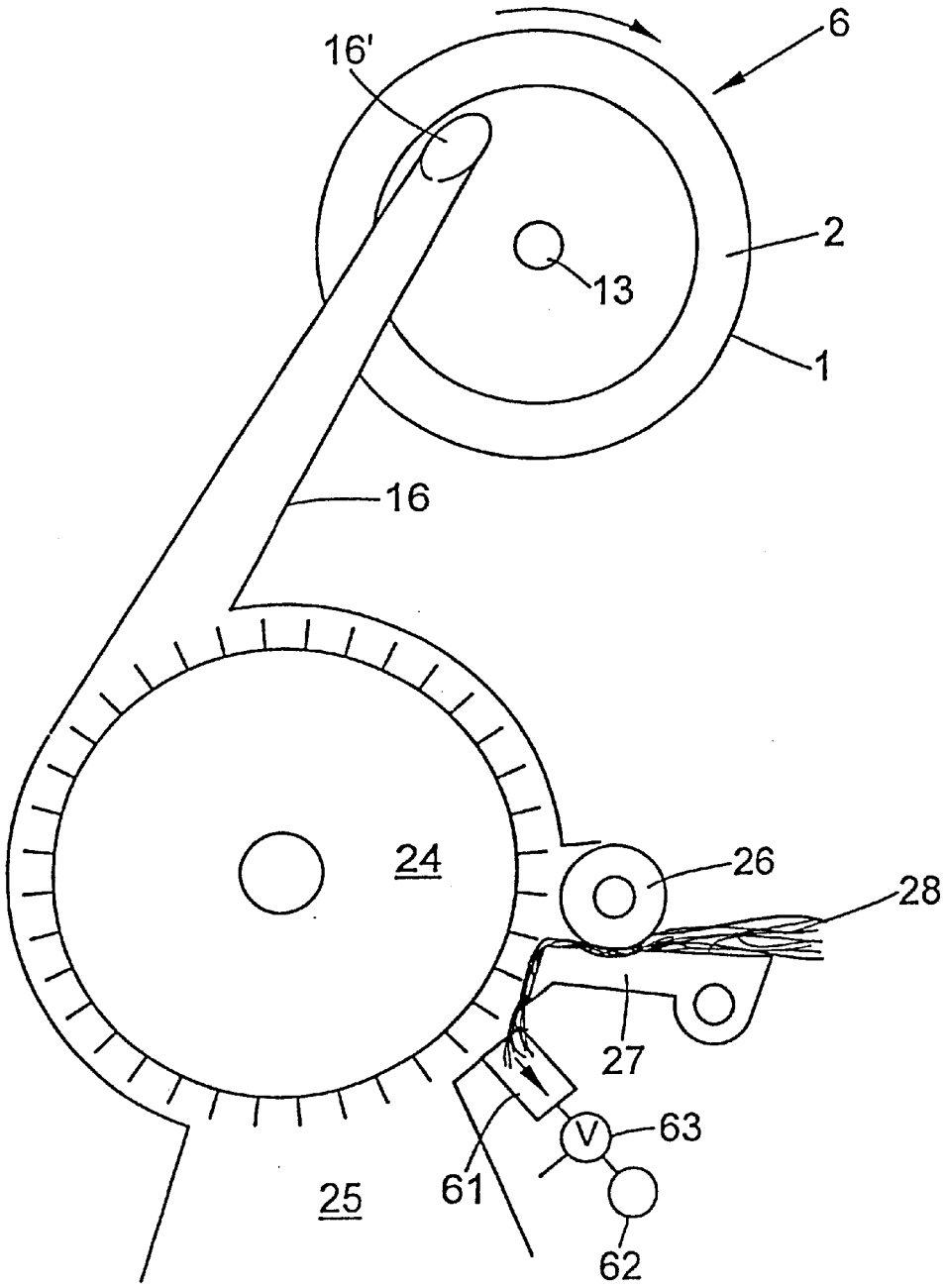

A variation is represented in FIG. 12, which shows a possibility for deflecting the fiber flow. A suction connector 61 is connected via a valve 63 with a suction air source 62. This suction air source 62 can again be arranged on the piecing cart or on the spinning station itself. If suction is applied to the suction connector 61, the sliver fed in by means of the feed roller 26 over the clamping table is kept away from the fittings of the opening cylinder 24 and is therefore not further combed out. After a short running time of the opening cylinder with a supply of sliver, no fibers are present anymore on the opening cylinder 24. The shut-off of the suction air at the suction connector 61 by means of the valve 63 takes place early enough so that, when the phase 7 from FIG. 9 has been reached, the fiber flow is fully available again in the rotor. However, other arrangements of the suction connector 61 along the running direction of the opening cylinder 24, or even in the fiber guide channel 16, are also conceivable.

What is claimed is:

1. A method for open-end rotor spinning, wherein the fibers to be spun are conveyed via a fiber guide channel (16) into the rotor (6), are collected in its rotor groove (1) of the largest interior diameter, are tied while being twisted into the yarn end in the area of a so-called tie-in zone (5) by means of the rotor rotation and are drawn off as finished yarn through a draw-off nozzle (7, 11), which is arranged centered and substantially on one level with the rotor groove (1), wherein the fiber flow exiting from a fiber guide channel (16) has a directional component in the direction of rotation of the rotor, and wherein the yarn leg (3) extending from the draw-off nozzle (7, 11) to the rotor groove (1) is curved, at least in the vicinity of the rotor groove (1), opposite the direction of rotation of the rotor during the spinning process.

2. The method in accordance with claim 1, characterized in that the fiber flow is essentially fed to a fiber slide surface (2) located between the rotor opening and the rotor groove (1).

3. The method in accordance with claim 1 or 2, characterized in that the direction of curvature of the yarn leg (3) is created during the piecing process.

4. The method in accordance with claim 3, characterized in that in a first phase of the piecing process a rotary flow directed tangentially opposite the direction of rotation of the rotor during its operation is caused to act on the yarn end introduced into the rotor (6) for piecing, which flow is sufficient for creating the intended direction of curvature of the yarn leg.

5. The method in accordance with claim 3, characterized in that in a first phase of the piecing process the rotor (6) is initially driven opposite the direction of rotation of the rotor during its operation in such a way that the intended direction of curvature of the yarn leg (3) occurs, and that the direction of rotation of the rotor during its operation does not exceed an angular acceleration T which could lead to the flipping of the direction of curvature.

6. The method in accordance with claim 3, characterized in that after its exit from the yarn draw-off tube, the yarn returned through the yarn draw-off tube (18) by means of the application of suction to the spinning chamber is aspirated into a radially spaced apart suction channel (51) by means of an auxiliary suction flow prevailing there and is fixed in place in this suction channel, thereafter the spinning vacuum is applied again and the rotor (6) is started, because of which a yarn loop extending in the rotor is aligned in the direction of rotation of the rotor and, by means of the subsequent release of the yarn end (3), the latter is deposited in the rotor groove (1) in such a way that it is oriented opposite the direction of rotation of the rotor.

7. The method in accordance with claim 6, characterized in that following the fixation of the yarn end (3) in the suction channel (51), yarn is continued to be fed through the yarn draw-off tube (18) until such a yarn loop has been formed which follows the rotor (6) which has again been put into operation.

8. The method in accordance with claim 6 or 7, characterized in that the yarn end (3) is cut to size in the suction channel (51), and the cut-to-size yarn end is fixed in place.

9. The method in accordance with claim 1, characterized in that during the orientation phase of the yarn end (3) the rotor (6) is kept free of fibers, and the feeding of fiber suddenly takes place only after the direction of curvature of the yarn end (3) in the rotor groove (1) has been sufficiently stabilized by means of centrifugal force.

* * * * *